US011385016B1

(12) United States Patent
Allen

(10) Patent No.: US 11,385,016 B1
(45) Date of Patent: Jul. 12, 2022

(54) EXTRA RAPID PROJECTILE TUBE HAND CANNON

(71) Applicant: Anthony L. Allen, Oakland, CA (US)

(72) Inventor: Anthony L. Allen, Oakland, CA (US)

( * ) Notice: Subject to any disclaimer, the term of this patent is extended or adjusted under 35 U.S.C. 154(b) by 0 days.

(21) Appl. No.: 17/336,245

(22) Filed: Jun. 1, 2021

(51) Int. Cl.
*F41B 3/02* (2006.01)
*F41B 7/00* (2006.01)
*F41B 7/08* (2006.01)

(52) U.S. Cl.
CPC ..... *F41B 7/003* (2013.01); *F41B 3/02* (2013.01); *F41B 7/08* (2013.01)

(58) Field of Classification Search
CPC .... F41B 3/005; F41B 3/02; F41B 5/14; F41B 5/1484; F41B 5/1488; F41B 7/003; F41B 7/08
USPC ..... 124/17, 20.1, 20.3, 22
See application file for complete search history.

(56) References Cited

U.S. PATENT DOCUMENTS 181,891 A * 9/1876 Algeo ..... F41B 7/04 124/22
368,588 A * 8/1887 Horton ..... F41B 7/04 124/22
1,375,776 A * 4/1921 Buys ..... F41B 3/02 124/20.3
1,379,944 A * 5/1921 Story ..... F41B 3/02 124/22
1,434,726 A * 11/1922 Akers ..... F41B 3/02 124/22
1,502,499 A * 7/1924 Deck ..... F42B 6/00 473/578
1,748,651 A * 2/1930 Holliday ..... F41B 3/02 124/24.1
2,522,060 A * 9/1950 Ridland ..... A01K 81/00 124/80
2,948,078 A * 8/1960 Miotke ..... A01K 91/02 124/16
3,194,226 A * 7/1965 Hoff ..... F41B 3/02 124/22
3,415,239 A * 12/1968 Swett ..... F41B 3/02 124/20.3
3,580,234 A * 5/1971 Guyer, Jr ..... F41B 3/02 124/64
3,742,637 A * 7/1973 Badovinac ..... A01K 91/02 43/19
4,027,418 A * 6/1977 Baldi ..... A01K 81/00 43/6

(Continued)

FOREIGN PATENT DOCUMENTS

CA 2460446 A1 9/2005
CN 210538310 U 5/2020

*Primary Examiner* — Alexander R Niconovich
(74) *Attorney, Agent, or Firm* — Fenwick & West LLP

(57) ABSTRACT

A multi-use projectile launching apparatus that includes a single piece body and attached elastic propulsion band to propel an object through a portion of the single piece body. The single piece body consists of a handle for supporting the apparatus, a projectile tube through which the propelled object travels, a funnel for receiving the propelled object and passing it to the projectile tube, and one or more attachment nodes for connecting an elastic propulsion band to the single piece body. Together these components form a device capable of launching several kinds of projectile objects at high speed by propelling the projectile object with elastic force.

8 Claims, 4 Drawing Sheets

(56) References Cited

U.S. PATENT DOCUMENTS 4,297,985 A * 11/1981 Rodriguez ..... F42B 6/04 124/83
4,548,190 A * 10/1985 Megargee ..... F41B 11/00 124/56
4,573,445 A * 3/1986 Webb ..... F41B 3/02 403/375
5,524,603 A * 6/1996 Menzer ..... F41B 7/04 124/20.3
6,823,855 B2 * 11/2004 Omi ..... F41B 3/02 124/35.2
7,409,794 B2 * 8/2008 Triano ..... A01K 91/02 249/117
7,448,371 B2 * 11/2008 Sapir ..... F41B 7/08 124/16
7,464,701 B1 * 12/2008 Mendoza ..... F41B 7/08 124/20.1
7,506,642 B2 * 3/2009 Edwards ..... F41B 3/02 124/20.1
9,220,246 B1 * 12/2015 Roman ..... A01K 81/04
9,414,578 B2 * 8/2016 Thornbrough ..... A01K 81/06
9,441,906 B2 * 9/2016 James ..... F41B 13/10
9,829,267 B1 * 11/2017 Nikolic ..... A01K 81/06
10,156,415 B2 * 12/2018 Perdue ..... F41B 5/0094
10,195,503 B1 * 2/2019 Lesh ..... F41J 9/18
10,197,080 B2 * 2/2019 Burge ..... F16B 7/18
10,386,153 B1 * 8/2019 Higgs ..... F41G 1/35
10,533,823 B1 * 1/2020 Smith ..... F41B 7/04
2012/0085330 A1 * 4/2012 Hickerson ..... A01K 81/04 124/22
2013/0192572 A1 * 8/2013 Shirk, II ..... F41B 3/02 124/20.1
2014/0283803 A1 * 9/2014 Maccarrick ..... F41B 5/143 124/20.3
2021/0048268 A1 * 2/2021 Trpkovski ..... F41B 3/02

* cited by examiner

EXTRA RAPID PROJECTILE TUBE HAND CANNON

BACKGROUND

1. Technical Field

The subject matter described generally relates to slingshot apparatuses and, in particular, to a slingshot apparatus for use in fishing and hunting.

2. Background Information

Some of the most common items used by survivalists, hunters, and fishers include those that launch a high-speed projectile at a chosen target. These kinds of weapons allow a user to hit their target with high accuracy and force. Many weapons exist that are able to release a high-speed projectile with one simple motion; these include guns, crossbows, handheld catapults, and slingshots. However, those weapons restrict users to just one kind of projectile, such that a user would have to switch weapons entirely to change from shooting bullets to arrows. Many existing projectile launching weapons are additionally not well suited to the outdoor elements such as inclement weather conditions. If they are not stored properly and cleaned after each use, these weapons can suffer the effects of rust and grime on small metal parts like springs, which eventually destroy the weapon. Thus, a single, weatherproof tool that can propel multiple types of projectiles is needed to simplify the hunting, fishing, and survivalist situations.

SUMMARY

The above and other problems may be addressed by a handheld slingshot-type weapon hereafter referred to as a hand cannon. The hand cannon uses stretched elastic to propel the chosen projectile, having a tubular body that is compatible with many types of projectiles. In a described aspect, the hand cannon is simple in its construction and consists of a single piece body with attached elastic.

Reference will now be made to several embodiments, examples of which are illustrated in the accompanying figures. It is noted that wherever practicable similar or like reference numbers are used in the figures to indicate similar or like functionality. Where similar elements are identified by a reference number followed by a letter, a reference to the number alone may refer to all such elements, any one such element, or any combination of such elements. One skilled in the art may recognize alternative embodiments of the described structures that may be employed without departing from the principles described.

DETAILED DESCRIPTION

Figure 3:
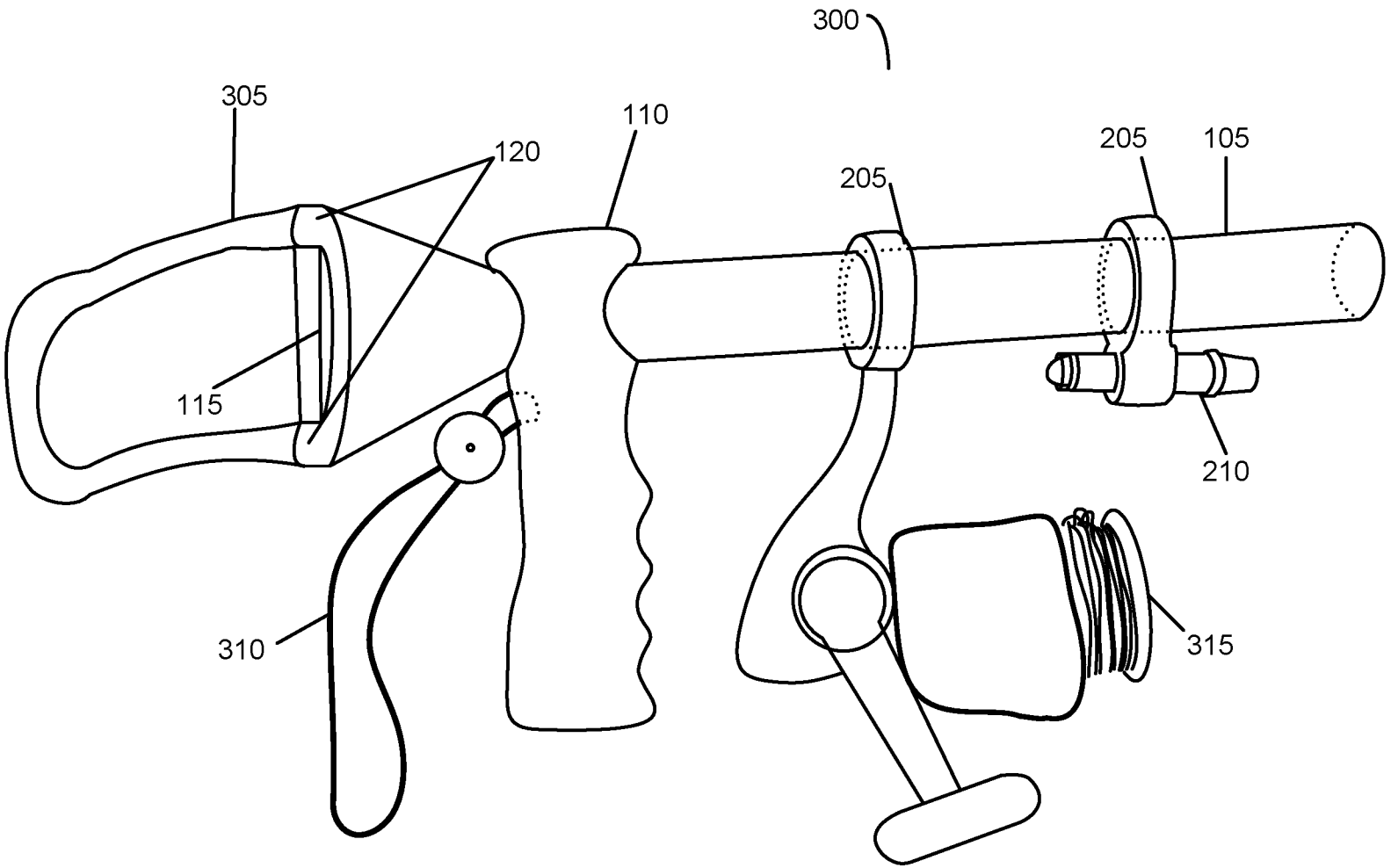
FIG. 3 illustrates one embodiment of the hand cannon with attached accessories.

Referring now to FIG. 3, hand cannon 300 is a hunting and survivalist device that launches high speed projectiles by propelling them with a slingshot-like elastic mechanism. Unlike typical slingshots which have a y-shape that holds an elastic band that is pulled back to propel a projectile, hand cannon 300 includes funnel 115 and tube 105 through with the projectile travels after being released by elastic propulsion band 305. These features make hand cannon 300 far more accurate than a typical slingshot toy because they direct the projectile toward the target. Unlike conventional devices with barrels that launch projectiles, such as rifles, the projectile object is not loaded into the barrel (i.e. tube 105) before use. Instead hand cannon 300 is loaded with a projectile by placing the projectile in contact with elastic propulsion band 305 or a conventional projectile pouch and pulling band 305 away from handle 110. Once propulsion band 305 is released the projectile travels toward funnel 115 which directs the projectile into tube 105. Other devices that launch projectiles exist and have a somewhat similar form to hand cannon 300; one such example is a cable caster. The hand cannon surpasses these devices in durability and ease of use by having no complex or small moving parts such as springs, joints, or hammers. Other projectile launching devices in this class use compressed air, springs, or electric means to launch the projectile, while the hand cannon uses an elastic propulsion band and mechanical strength of the user for propulsion.

To use hand cannon 300, a user holds handle 110 of hand cannon 300 in one hand to secure the apparatus. In the other hand, the user holds the chosen projectile and elastic propulsion band 305 with the chosen projectile resting on the inside of the propulsion band or in a conventional projectile pouch. The user then pulls the propulsion band 305 and chosen projectile away from handle 110. Extending propulsion band 305 builds elastic force such that the user can adjust the velocity and distance the projectile travel by adjusting how far they extend propulsion band 305. The user then aims hand cannon 300 at a target and releases propulsion band 305 and chosen projectile. Propulsion band 305 propels the projectile, and the projectile travels through projectile funnel 115 to projectile tube 105 toward the target aimed at by the user. In contrast to conventional slingshots, the projectile may, while passing though projectile tube 105, be slightly redirected by one or more incidents of contact with projectile tube 105, thereby making hand cannon 300 more forgiving of poor user aim based solely on a direction of pull of propulsion band 305. The aforementioned description of use may not be the only way in which the hand cannon can be used; other adaptations may exist.

Figure 1:
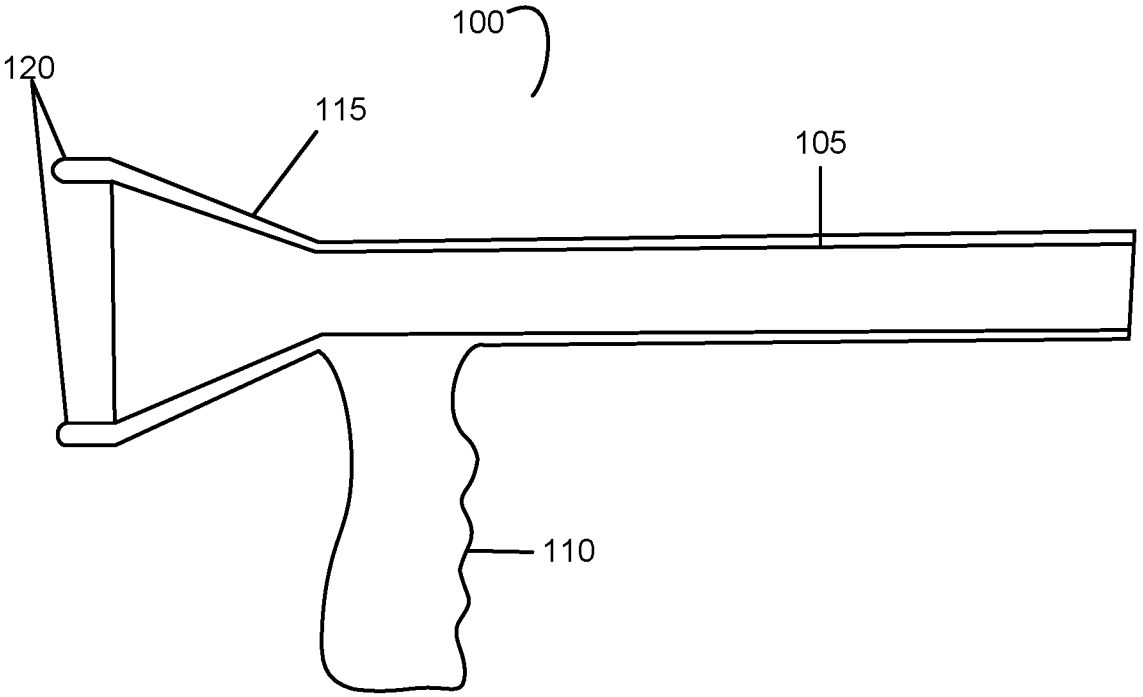
FIG. 1 illustrates a side, cut out view of the single piece body of the hand cannon.

FIG. 1 illustrates a side view of single piece body 100 of hand cannon 300. Making the body of hand cannon 300 with a single piece of material allows for both manufacturing simplicity as well as durability in use. Because single piece body 100 is meant to be made of one piece of material, it can be created through processes such as 3D printing or injection molding. In one manner of 3D printing, single piece body 100 is oriented such that it is resting on the flat opening of projectile tube 105. This orientation allows for continuous application of material to single piece body 100 but necessitates the use of supports to prevent the piece from falling or moving during printing. As such, in this manner single piece body 100 is 3D printed along with a variety of supports that are later removed and do not interfere in use of hand cannon 300. Single piece body 100 is more durable than known apparatuses because it eliminates problems caused by small parts such as springs, triggers, screws, and more that can be easily broken. A user does not have to take apart single piece body 100 of hand cannon 300 to clean it. Instead the apparatus can simply be submerged in water to remove any dirt or debris that collects on its surfaces.

Handle 110 is designed for ease of grip and control of the device. Handle 110 design includes grooves for the user's fingers and/or rough texturing. Handle 110 extends approximately perpendicularly from projectile tube 105. The length of handle 110 ranges from approximately 3 to 10 inches in different embodiments. In one embodiment the handle 110 is hollow to decrease the weight of the hand cannon and allow it to float in water. This embodiment is preferred for use of the hand cannon near water such as for fishing. In another embodiment, handle 110 is solid. In hollow-handled embodiments a compartment exists inside the handle for storage. The compartment is configured such that projectiles such as collapsible arrows and small bullet-type projectiles (i.e. ball bearings, BBs, etc.) fit within it. In several embodiments the handle has an attachment portion through which a loop 310 of cord or a lanyard can be attached such that the user can secure hand cannon 300 to their wrist or hang it for storage.

Projectile tube 105 of single piece body 100 has the form of a pipe, meaning that it is hollow with a circular cross section and is open on both ends. Projectile tube 105 functions to direct the projectile toward the length of projectile tube 105 can range from approximately 4 to 20 inches in different embodiments while the inner diameter of projectile tube 105 can range from approximately 1 to 3 inches. Different applications and desired projectile types may call for different dimensions.

Projectile funnel 115 of the single piece body is a hollow cone with a circular cross section and has one side connected to projectile tube 115. Projectile funnel 115 aids in directing the projectile toward the target. For example, if propulsion band 305 loaded with the projectile is released at an angle that does not align with the center of projectile tube 105, the wide mouth of the projectile funnel corrects this error and directs the projectile properly down the center of projectile tube 105. The cross section on the side further from projectile tube 105 has a first diameter that is larger than the second diameter on the side attached to projectile tube 105. The first diameter ranges from approximately 1 to 8 inches while the second diameter ranges from approximately 1 to 3 inches in different embodiments. Again, different applications and desired projectile types may call for different dimensions.

Attachment nodes 120 extend from single piece body 100 and allow propulsion band 305 to securely connect to single piece body 100. In one embodiment in which propulsion band 305 is tubular, attachment nodes 120 are rounded protrusions that the ends of the band are press fit onto. In another embodiment in which propulsion band 305 is a solid ribbon, attachment nodes 120 are loops the propulsion band can be tied to. Other embodiments of attachment including hooks, clips, or slots are possible. Orientation and number of the attachment nodes (e.g., dual horizontal, dual vertical or triple at 120-degree offsets) and propulsion band configurations may be different for different applications and embodiments.

Propulsion band 305 is a separate piece that can be attached or detached from single piece body 100. Propulsion band 305 in FIG. 3 is a c-shaped loop with both ends connected to attachment nodes 120 of single piece body 100. Propulsion band 305 is made of elastic material that exerts a force when stretched. As used herein, the word elastic is taken to mean a material that can stretch to a second length longer than its initial length when a user applies a pulling force, and in response the elastic will apply a force and revert to approximately its initial length once the pulling force applied from the user is gone. In the embodiment illustrated in FIG. 3, propulsion band 305 is a single piece of elastic material having both of its ends attached to attachment nodes 120 of single piece body 100. In one specific embodiment, propulsion band 305 is a hollow elastic tube. In another embodiment propulsion band 305 is a solid elastic ribbon. If propulsion band 305 is over-exerted and loses its strength or is otherwise severed, propulsion band 305 can be removed from single piece body 100 and replaced with another propulsion band. In an embodiment for general-purpose hunting and fishing use, the unstretched length of propulsion band 305 ranges from 5 to 25 inches. In such an embodiment, propulsion band 305 is a conventional item that can be sourced from many retailers. For example, propulsion band 305 can be made from a conventional rubber band that is cut from a loop to a ribbon and then attached to attachment nodes 120. In the illustrated embodiment, the conventionality of propulsion band 305 makes it easily replaceable in the case of wear or damage. A user of hand cannon 300 may choose to alter the strength and/or elasticity of the propulsion band by cutting it to a shorter length.

The projectile pouch, not shown in the figures, is used to stabilize the projectile as it is being loaded and launched by the propulsion band. The projectile pouch attaches to, or is formed integrally with, propulsion band 305. The projectile pouch provides a surface on which the projectile can be braced as the propulsion band is pulled back and the hand cannon aimed. The projectile pouch is a conventional item used in other slingshot devices and, as such, can be found at many retailers. Again, the conventionality of the projectile pouch allows for it to be easily replaced in the case that it becomes worn or damaged by use.

Figure 2A:
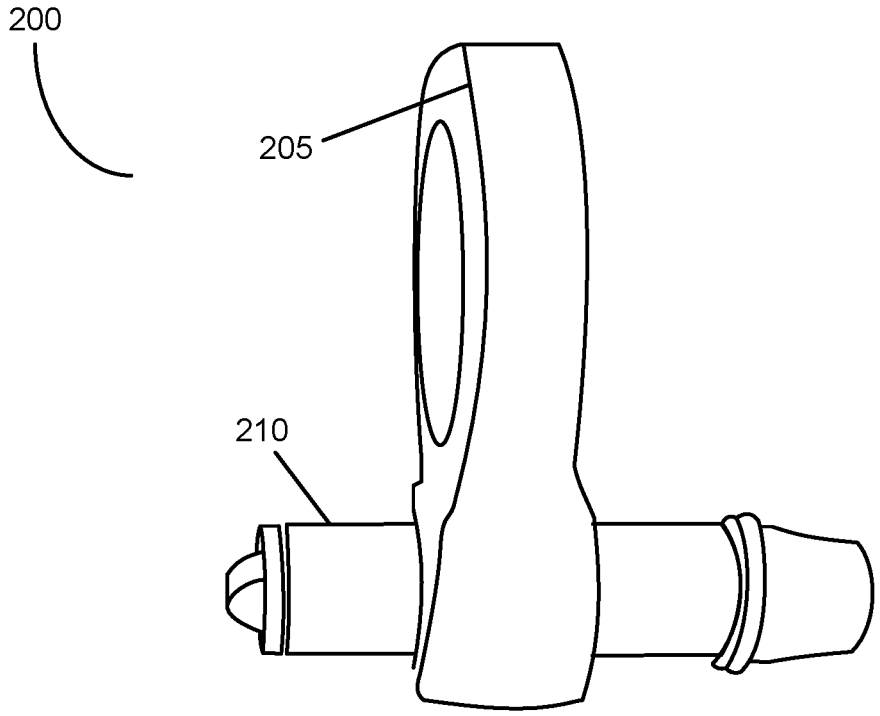
FIGS. 2A and 2B illustrate an attachment for the hand cannon in the form of a laser sight.
Figure 2B:
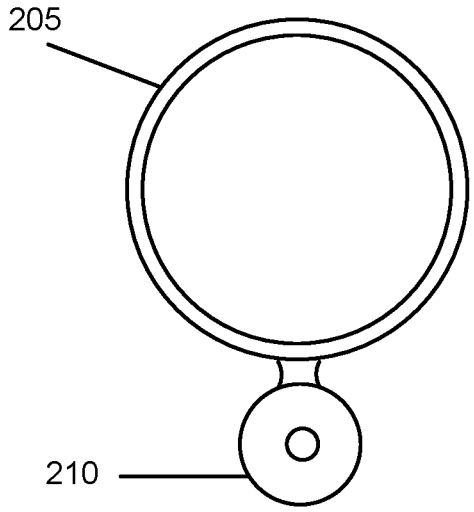

FIGS. 2A and 2B illustrate an accessory 200 for hand cannon 300 in the form of laser sight 210. With just single piece body 100 and propulsion band 305, hand cannon 300 is entirely functional and can launch high-speed projectiles of the user's choice. Optional accessories attach to complement the functionality of the hand cannon. In one embodiment, accessory 200 is attached to hand cannon via attachment loop 205 that is threaded onto projectile tube 105. In other embodiments accessories 200 are attached to any other portion of propulsion band 305 or single piece body 100 through any suitable means of attachment. Accessories 200 for hand cannon 300 are meant to augment the uses of the device. For example, if a user wanted to use hand cannon 300 at night, they might equip a flashlight accessory that shines light on the target and attaches to the projectile tube in a similar fashion as the laser sight shown in FIG. 2A. In another example, if the hand cannon is used for fishing, the user equips a fishing reel and attaches fishing line to the projectile of choice such that the projectile is retrievable by reeling in the fishing line with the fishing reel.

Referring again to FIG. 3, multiple such accessories for one embodiment of hand cannon 300 are illustrated. The combination of accessories shown in FIG. 3 includes fishing reel 315 with fishing line, laser sight 210, and loop 310 for carrying or hanging hand cannon 300.

The embodiment shown is only one potential embodiment of accessory combinations and placements along the hand cannon.

Figure 4:
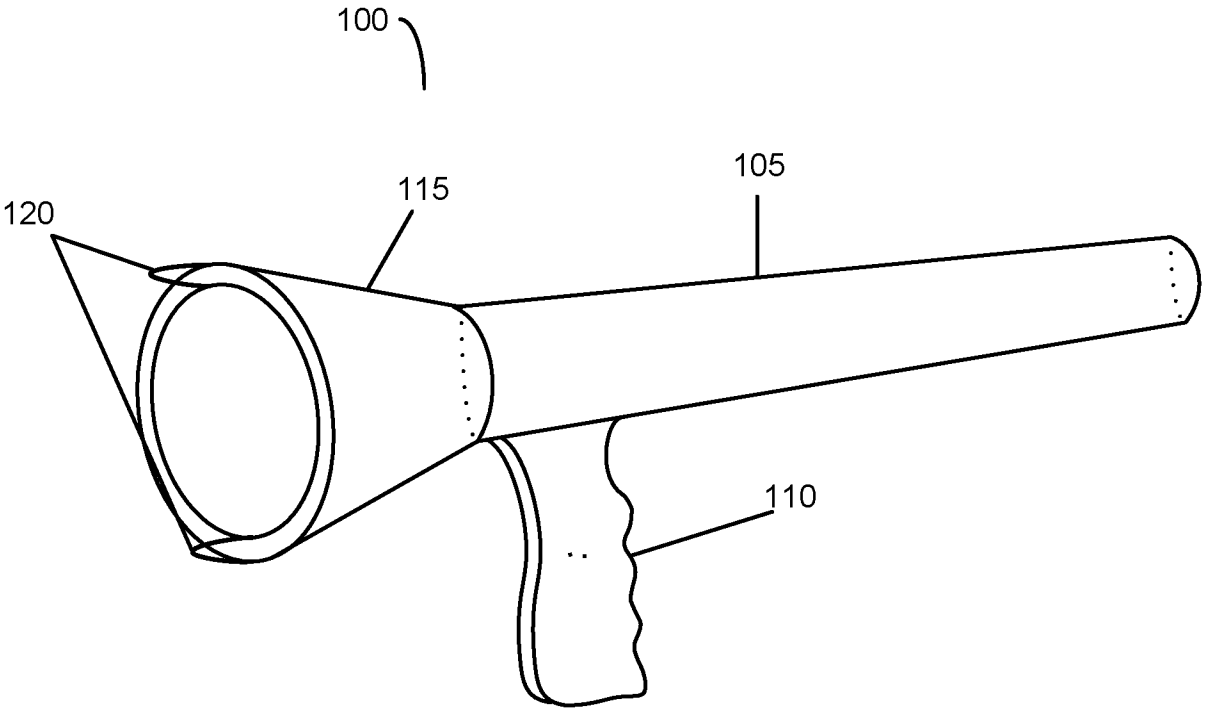
FIG. 4 illustrates one embodiment of the single piece body from a ¾ view.

FIG. 4 illustrates one embodiment of single piece body 100 of hand cannon 300 from a ¾ view. FIG. 4 has the same features as described in the above description of FIG. 1. The embodiment shown in FIG. 4 of single piece body 100 includes projectile tube 105, handle 110, projectile funnel 115, and attachment nodes 120.

As used herein, any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment. Similarly, use of "a" or "an" preceding an element or component is done merely for convenience. This description should be understood to mean that one or more of the element or component is present unless it is obvious that it is meant otherwise.

Where values are described as "approximate" or "substantially" (or their derivatives), such values should be construed as accurate+/−10% unless another meaning is apparent from the context. From example, "approximately ten" should be understood to mean "in a range from nine to eleven."

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Upon reading this disclosure, those of skill in the art will appreciate still additional alternative structural and functional designs for a hand cannon apparatus. Thus, while particular embodiments and applications have been illustrated and described, it is to be understood that the described subject matter is not limited to the precise construction and components disclosed. The scope of protection should be limited only by the following claims.

What is claimed is:

1. A projectile launching apparatus comprising:

a propulsion band of elastic material;

a single piece body comprised of a single, continuous piece of material for improved durability and manufactured via 3D printing or injection molding, the single piece body comprising:

a projectile tube having interior and exterior surfaces;

a projectile funnel having a tapered shape defining a first side connected to the projectile tube having a first cross-sectional diameter and a second opposite side having a second cross-sectional diameter, wherein the first cross-sectional diameter is smaller than the second cross-sectional diameter;

one or more rounded attachment nodes configured to affix the propulsion band to the single piece body via press fitting, wherein the one or more rounded attachment nodes extend from the second side of the projectile funnel; and a hollow handle, wherein an inner portion of the hollow handle comprises a storage compartment.

2. The projectile launching apparatus of claim 1, wherein one or more accessories comprising a fishing reel, laser sight, or flashlight attach to the exterior surface of the projectile tube.

3. The projectile launching apparatus of claim 1, wherein the projectile tube has a size factor that allows multiple kinds of projectiles to pass through while providing the projectiles guidance.

4. The projectile launching apparatus of claim 1 wherein the single piece body includes supports to facilitate 3D printing, wherein the supports are removable after 3D printing is complete.

5. The projectile launching apparatus of claim 1, wherein the propulsion band consists of a hollow tube or solid band of elastic material.

6. The projectile launching apparatus of claim 1, wherein the hollow handle further comprises an attachment portion through which a carrying loop can be threaded.

7. The projectile launching apparatus of claim 1, wherein the hollow handle extends perpendicularly from the projectile tube.

8. A projectile launching apparatus for hunting and fishing, the projectile launching apparatus comprising:

a single piece body of the projectile launching apparatus comprised of a single, continuous piece of material for improved durability that is 3D printed or injection molded, the single piece body of the projectile launching apparatus comprising:

a projectile funnel having a first opening having a first diameter through which a chosen projectile is received, and a second opening having a second diameter, equal to or smaller than the first diameter, through which the chosen projectile is expelled;

a projectile tube having a first opening of the projectile tube attached to the second opening of the projectile funnel and receiving the chosen projectile from the projectile funnel, and a second opening of the projectile tube expelling the chosen projectile toward a target; and a hollow handle for supporting the body of the projectile launching apparatus attached the projectile tube wherein an inner portion of the hollow handle comprises a storage compartment;

a sling shot mechanism comprising:

attachment nodes having a rounded shape extending from the first opening of the projectile funnel configured to affix a propulsion band to the single piece body via press fitting;

the propulsion band of elastic material attached to the body of the projectile launching apparatus via the attachment nodes; and a projectile pouch attached to the propulsion band for holding a chosen projectile, the projectile launching apparatus being compatible with more than one kind of projectile;

a laser sight removably attached to the projectile tube;

a fishing reel removably attached to the projectile tube;

a flashlight removably attached to the projectile tube; and a carrying loop removably attached to the hollow handle.

* * * * *